US009349318B2

(12) United States Patent
Jung

(10) Patent No.: US 9,349,318 B2
(45) Date of Patent: May 24, 2016

(54) PIXEL CIRCUIT, DRIVING METHOD FOR THRESHOLD VOLTAGE COMPENSATION, AND ORGANIC LIGHT EMITTING DISPLAY DEVICE USING THE SAME

(71) Applicant: LG Display Co., Ltd., Seoul (KR)

(72) Inventor: Jin-Hyun Jung, Busan (KR)

(73) Assignee: LG Display Co., Ltd., Seoul (KR)

( * ) Notice: Subject to any disclaimer, the term of this patent is extended or adjusted under 35 U.S.C. 154(b) by 122 days.

(21) Appl. No.: 14/079,332

(22) Filed: Nov. 13, 2013

(65) Prior Publication Data

US 2014/0152719 A1 Jun. 5, 2014

(30) Foreign Application Priority Data

Dec. 4, 2012 (KR) ..... 10-2012-0139335

(51) Int. Cl.
*G09G 3/32* (2006.01)

(52) U.S. Cl.
CPC ..... *G09G 3/3233* (2013.01); *G09G 2300/0819* (2013.01); *G09G 2300/0852* (2013.01); *G09G 2300/0861* (2013.01); *G09G 2310/061* (2013.01); *G09G 2320/0233* (2013.01)

(58) Field of Classification Search
CPC ..... G09G 3/3233; G09G 2300/0819; G09G 2320/0233
USPC ..... 345/77, 691
See application file for complete search history.

(56) References Cited

U.S. PATENT DOCUMENTS

2008/0030443 A1 2/2008 Yamashita et al.
2008/0074357 A1* 3/2008 Kanda ..... 345/76
2008/0088547 A1 4/2008 Chan et al.
2010/0253608 A1 10/2010 Kim et al.
2012/0306843 A1* 12/2012 Wang et al. ..... 345/212

FOREIGN PATENT DOCUMENTS

CN 101714333 A 5/2010
CN 101866619 A 10/2010

* cited by examiner

*Primary Examiner* — Jonathan Blancha
(74) *Attorney, Agent, or Firm* — Fenwick & West LLP

(57) ABSTRACT

Disclosed are a pixel circuit and an organic light emitting display device using the same. The pixel circuit includes a light emitting element configured to include an organic emission cell formed between an anode and cathode of the light emitting element, a driving transistor configured to control emission of light from the light emitting element according to a voltage applied between a gate and source of the driving transistor, a data capacitor configured to include a first terminal and a second terminal; and a switching unit configured to initialize a voltage of the data capacitor during an initialization period, store a threshold voltage of the driving transistor during a threshold voltage storage period, store the data voltage in the data capacitor during a data voltage storage period, and emit light from the light emitting element by using the data voltage stored in the data capacitor during an emission period.

10 Claims, 18 Drawing Sheets

PIXEL CIRCUIT, DRIVING METHOD FOR THRESHOLD VOLTAGE COMPENSATION, AND ORGANIC LIGHT EMITTING DISPLAY DEVICE USING THE SAME

CROSS-REFERENCE TO RELATED APPLICATIONS

This application claims the benefit of the Korean Patent Application No. 10-2012-0139335 filed on Dec. 4, 2012, which is hereby incorporated by reference as if fully set forth herein.

BACKGROUND

1. Field of the Invention

The present invention relates to a pixel circuit and an organic light emitting display device including the same, and more particularly, to a pixel circuit, a driving method thereof, and an organic light emitting display device including the same, which compensate for a threshold voltage of a driving transistor that controls emission of light from a light emitting element.

2. Discussion of the Related Art

Recently, with the advancement of multimedia, the importance of flat panel display (FPD) devices is increasing. Therefore, various types of FPD devices such as liquid crystal display (LCD) devices, plasma display panel (PDP) devices, field emission display (FED) devices, and light emitting display devices are being used. In such FPD devices, the light emitting display devices have a fast response time of 1 ms or less and low power consumption, and have no limitation in a viewing angle because the organic light emitting display devices self-emit light. Accordingly, the organic light emitting display devices are attracting much attention as next generation FPD devices.

Generally, light emitting display devices are display devices that electrically excite a light emitting material to emit light, and are categorized into inorganic light emitting display devices and organic light emitting display devices depending on a material and a structure thereof.

FIG. 1 is a circuit diagram schematically illustrating a pixel circuit of a general organic light emitting display device.

The pixel circuit of the general organic light emitting display device, as illustrated in FIG. 1, includes a switching transistor ST, a driving transistor DT, and a capacitor C, and a light emitting element OLED.

The switching transistor ST is turned on by a scan signal supplied to a scan line SL, and supplies a data voltage Vdata, supplied from a data line DL, to the driving transistor DT.

The driving transistor DT is turned on with the data voltage Vdata supplied from the switching transistor ST, and controls a data current Ioled which flows from a driving voltage Vdd terminal to the light emitting element OLED.

The capacitor C is connected between a gate and source of the driving transistor DT, stores a voltage corresponding to the data voltage Vdata supplied to the gate of the driving transistor DT, and turns on the driving transistor DT with the stored voltage.

The light emitting element OLED is electrically connected between a drain of the driving terminal DT and a ground voltage Vss terminal, and emits light with the data current Ioled supplied from the driving transistor DT. Here, the data current Ioled flowing in the light emitting element OLED is determined according to a gate-source voltage Vgs of the driving transistor DT, a threshold voltage Vth of the driving transistor DT, and the data voltage Vdata.

The pixel circuit of the general organic light emitting display device controls a level of the data current Ioled, which flows from the driving voltage Vdd terminal to the light emitting element OLED, with a switching time of the driving TFT DT based on the data voltage Vdata to emit light from the light emitting element OLED, thereby displaying a certain image.

However, in the pixel circuit of the general organic light emitting display device, the data current Ioled flowing in the light emitting element OLED may be changed due to a threshold voltage deviation of the driving transistor DT and a drop of a driving voltage Vdd. Therefore, despite the same data voltage Vdata, the data current Ioled output from each of the plurality of driving transistors DT is changed, and due to this, the pixel circuit of the general organic light emitting display device cannot realize a uniform quality of an image.

In addition, as the size of organic light emitting display devices is enlarged, the threshold voltage deviation of the driving transistor DT and the drop of the driving voltage Vdd become more severe. Due to this, an image quality of organic light emitting display devices having a large size is degraded.

That is, the light emitting element OLED is a current control element, and a current flowing through the light emitting element is controlled by the driving transistor DT connected to the light emitting element OLED. Here, due to a process differential, a threshold voltage and mobility of the driving transistor DT that controls a current are determined differently between a plurality of pixels. Therefore, even when a data signal (a data voltage) corresponding to the same gray scale is supplied to the driving transistor DT, a plurality of the light emitting elements OLED emit light having different luminance due to a threshold voltage difference and mobility difference between a plurality of the driving transistors DT. Also, due to a circuit resistor, the driving voltage Vdd applied to the light emitting element OLED is changed between when light is emitted and when light is not emitted. Due to this, the light emitting element OLED emits light having luminance different from desired luminance. That is, due to such problems, organic light emitting display devices of the related art have non-uniform luminance. As a size of organic light emitting display devices is enlarged, the above-described problems become more severe.

SUMMARY

Accordingly, the present invention is directed to provide a pixel circuit, a driving method thereof, and an organic light emitting display device including the same that substantially obviate one or more problems due to limitations and disadvantages of the related art.

An aspect of the present invention is directed to provide a pixel circuit, a driving method thereof, and an organic light emitting display device including the same, which can remove an influence of a threshold voltage of a driving transistor that controls emission of light from a light emitting element.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these and other advantages and in accordance with the purpose of the invention, as embodied and broadly described herein, there is provided a pixel circuit including: a light emitting element configured to include an organic emission cell formed between an anode and a cathode of the light emitting element, and emit light by an electrical flow; a driving transistor configured to control emission of light from the light emitting element according to a voltage applied between a gate and a source of the driving transistor; a data capacitor configured to include a first terminal, which is connected to a first node on a reference line receiving a reference voltage, and a second terminal connected to a second node which is connected to a data line receiving a data voltage and the gate of the driving transistor; and a switching unit configured to initialize a voltage of the data capacitor during an initialization period, store a threshold voltage of the driving transistor during a threshold voltage storage period, store the data voltage in the data capacitor during a data voltage storage period, and emit light from the light emitting element by using the data voltage stored in the data capacitor during an emission period.

In another aspect of the present invention, there is provided a method of driving a pixel circuit, which includes a light emitting element, a driving transistor that controls emission of light from the light emitting element, a data capacitor connected to a gate of the driving transistor, and a switching unit that drives the driving transistor with a data voltage stored in the data capacitor to emit emission of light from the light emitting element, including: during an initialization period, supplying a reference voltage to the switching unit to initialize the data capacitor; during a threshold voltage storage period, supplying the reference voltage to the switching unit to maintain the initialization state of the data capacitor and store a threshold voltage of the driving transistor in the switching unit; during a data voltage storage period, supplying the reference voltage and a data voltage to the switching unit to store the data voltage in the data capacitor and store the threshold voltage in the switching unit; and during an emission period, supplying the threshold voltage to a source of the driving transistor, and supplying the data voltage to the gate of the driving transistor to turn on the driving transistor to emit light from the light emitting element.

In another aspect of the present invention, there is provided a method of driving a pixel circuit, which includes a light emitting element, a driving transistor that controls emission of light from the light emitting element, a data capacitor connected to a gate of the driving transistor, and a switching unit that drives the driving transistor with a data voltage stored in the data capacitor to emit emission of light from the light emitting element, including: during an initialization period, supplying a reference voltage to the switching unit to initialize the data capacitor; during a threshold voltage storage period, supplying the reference voltage to the switching unit to maintain the initialization state of the data capacitor and store a mobility voltage, associated with a mobility of the driving transistor, in the switching unit; during a data voltage storage period, supplying the reference voltage and a data voltage to the switching unit to store the data voltage in the data capacitor and store the mobility voltage in the switching unit; and during an emission period, supplying the mobility voltage and the reference voltage to a source of the driving transistor, and supplying the data voltage to the gate of the driving transistor to turn on the driving transistor to emit light from the light emitting element.

In another aspect of the present invention, there is provided an organic light emitting display device including: a display panel configured to include a plurality of pixels which each include the pixel circuit; a data driver configured to supply the reference voltage and the data voltage to the switching unit of the pixel circuit; and a scan driver configured to drive the switching unit of the pixel circuit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Hereinafter, embodiments of the present invention will be described in detail with reference to the accompanying drawings.

Figure 1:
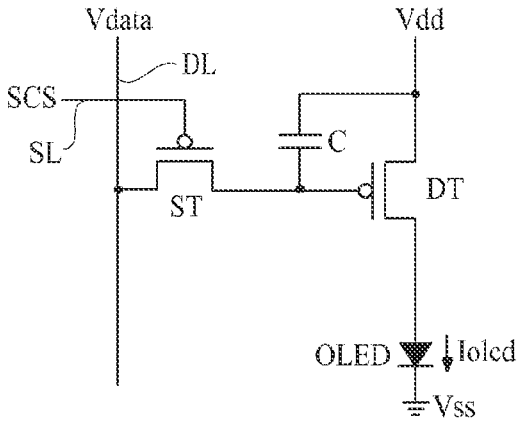
FIG. 1 [ Related Art ]
FIG. 1 is a circuit diagram schematically illustrating a pixel circuit of a general organic light emitting display device.
Figure 2:
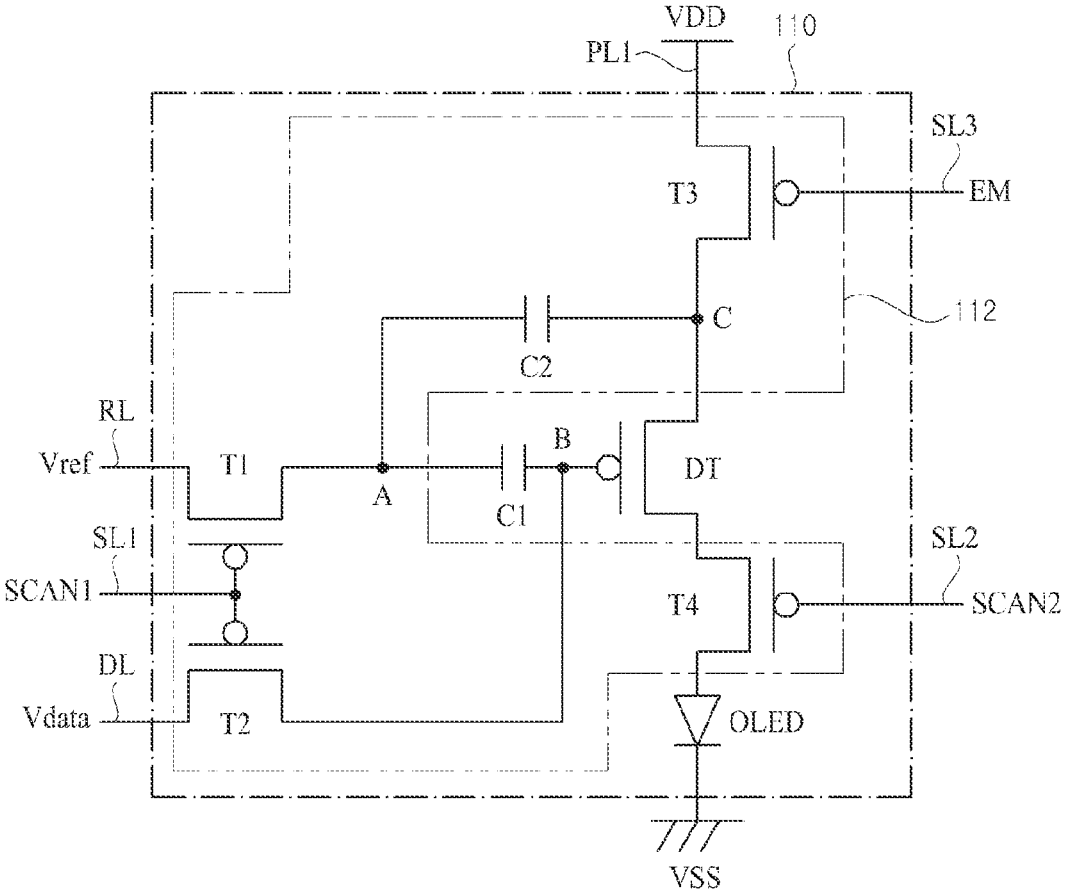
FIG. 2 is a circuit diagram schematically illustrating a pixel circuit according to an embodiment of the present invention.

FIG. 2 is a circuit diagram schematically illustrating a pixel circuit 110 according to an embodiment of the present invention.

The pixel circuit 110 according to an embodiment of the present invention, as illustrated in FIG. 2, includes: a light emitting element OLED that includes an organic emission cell formed between an anode and a cathode of the light emitting element OLED, and emits light by an electrical flow; a driving transistor DT that controls emission of light from the light emitting element OLED according to a voltage applied between a gate and a source of the driving transistor DT; a data capacitor C1 that includes a first terminal, which is connected to a first node A on a reference line RL receiving a reference voltage Vref, and a second terminal which is connected to a second node B which is connected to a data line DL receiving a data voltage and the gate of the driving transistor DT; and a switching unit 112 that, during a horizontal period, initializes a voltage of the data capacitor C1, stores a threshold voltage of the driving transistor DT, and stores the data voltage in the data capacitor C1, and during an emission period, emits light from the light emitting element OLED by using the data voltage stored in the data capacitor C1.

The driving transistor DT includes the gate connected to the second node B, the source connected to a third node C receiving a driving voltage VDD, and a drain connected to the light emitting element OLED. The drain of the driving transistor DT is connected to the light emitting element OLED through a fourth switching transistor T4 which configures the switching unit 112. The driving transistor DT is turned on according to a gate-source voltage based on the data voltage Vdata stored in the data capacitor C1, and supplies a data current, which is determined by a difference between the data voltage Vdata and the reference voltage Vref, to the light emitting element OLED to emit light from the light emitting element OLED. As illustrated in FIG. 2, when the driving transistor DT is configured with a thin film transistor having a P-type conductivity, the driving transistor DT has a threshold voltage Vth less than 0 V.

The data capacitor C1 is initialized according to the turn-on/off of first to fourth switching transistors T1 to T4 configuring the switching unit 112, stores the data voltage Vdata, and turns on the driving transistor DT according to the data voltage Vdata. To this end, the data capacitor C1 includes the first terminal connected to the first node A and the second terminal connected to the second terminal.

The first terminal of the data capacitor C1 is connected to the first switching transistor T1 of the switching unit 112. The reference voltage Vref is supplied to the first terminal of the data capacitor C1 according to the first switching transistor T1 being turned on.

The second terminal of the data capacitor C1 is connected in common to the second node B (i.e., the gate of the driving transistor DT) and the second switching transistor T2 of the switching unit 112.

The light emitting element OLED emits light according to a data current which is applied thereto when the driving transistor DT is turned on. To this end, the light emitting element OLED includes an organic emission cell which is formed between the anode and the cathode. Here, the organic emission cell may be formed to have a structure of a hole transport layer/organic emission layer/electron transport layer or a structure of a hole injection layer/hole transport layer/organic emission layer/electron transport layer/electron injection layer. Further, the emission cell may further include a function layer for enhancing the emission efficiency and/or service life of the organic emission layer.

Finally, the switching unit 110 removes an influence of the threshold voltage Vth of the driving transistor DT, and emits light from the light emitting element OLED with a data current which is determined by a difference between the data voltage Vdata and the reference voltage Vref.

To this end, the data voltage Vdata is applied to the data line DL, and the reference voltage Vref is applied to the reference line RL. The switching unit 112 stores the threshold voltage of the driving transistor DT, stores the data voltage Vdata in the data capacitor C1, and emits light from the light emitting element OLED with the data voltage Vdata, according to first to third switching control signals SCAN1, SCAN2, and EM.

The switching unit 112 is separately driven during an initialization period, a threshold voltage storage period, a data voltage storage period, and an emission period.

As an example of a method of driving the switching unit 112, first, the switching unit 112 initializes a voltage of each of the data capacitor C1, an assistant capacitor C2, the first node A, the second node B, and the third node C by using the reference voltage Vref and the driving voltage VDD. At this point, the switching unit 112 opens the fourth transistor T4, thereby removing a current which remains in the light emitting element OLED.

Second, during the threshold voltage storage period, the switching unit 112 floats the third node C, and stores the threshold voltage of the driving transistor DT in the assistant capacitor C2.

Third, during the data voltage storage period, the switching unit 112 applies the data voltage Vdata to the data line DL, and stores the data voltage Vdata in the data capacitor C1.

Finally, during the emission period, the switching unit 112 emits light from the light emitting element OLED by using the data voltage Vdata stored in the data capacitor C1.

The switching unit 112 is turned on according to the first to third switching control signals SCAN1, SCAN2, and EM, initializes the data capacitor C1 during the initialization period, stores the threshold voltage Vth of the driving transistor DT in the assistant capacitor C2 during the threshold voltage storage period, stores the data voltage Vdata in the data capacitor C1 during the data voltage storage period, and emits light from the light emitting element OLED with the data voltage Vdata during the emission period.

In first to third embodiments of the present invention, a detailed method of driving the switching unit 112 will be described below with reference to FIGS. 3 to 8.

The switching unit 112 performing the above-described function is connected to the data line DL, the reference line RL, the first terminal of the data capacitor C1, the source and drain of the driving transistor DT, the anode of the light emitting element OLED, a first switching control signal supply line SL1, a second switching control signal supply line SL2, a third switching control signal supply line SL3, and a driving voltage VDD supply line PL.

To this end, the switching unit 112 includes the first to fourth switching transistors T1 to T4 and the assistant capacitor C2.

The first switching transistor T1 is turned on according to the first switching control signal SCAN1, and supplies the reference voltage Vref to the first terminal (the first node A) of the data capacitor C1.

The second switching transistor T2 is turned on according to the first switching control signal SCAN1, and supplies the data voltage Vdata to the second terminal (the second node B) of the data capacitor C1.

The third switching transistor T3 is turned on according to the third switching control signal EM, and supplies the driving voltage VDD to the source of the driving transistor DT.

The fourth switching transistor T4 is turned on according to the second switching control signal SCAN2, and supplies a current, which is output from the driving transistor DT, to the light emitting element OLED.

The assistant capacitor C2 is connected between the first node A and the third node C which is connected to the source of the driving transistor DT.

The reference voltage Vref is set to a voltage value lower than a driving voltage of the light emitting element OLED, and for example, may be set to a voltage value of 0 V to less than 2 V. In this case, since the switching unit 112 emits light from the light emitting element OLED with a data current which is determined by a difference between the data voltage Vdata and the reference voltage Vref, the reference voltage Vref may ideally have 0 V, but may be set to 1 V for realizing a black gray scale. When the reference voltage Vref exceeds 0 V, each of data voltages by gray scale corresponding to N-bit digital input data may be set to a voltage obtained by compensating for the reference voltage Vref.

Each of the first to fourth switching transistors T1 to T4 may be configured with a thin film transistor (for example, a PMOS transistor) having a P-type conductivity.

Figure 3:
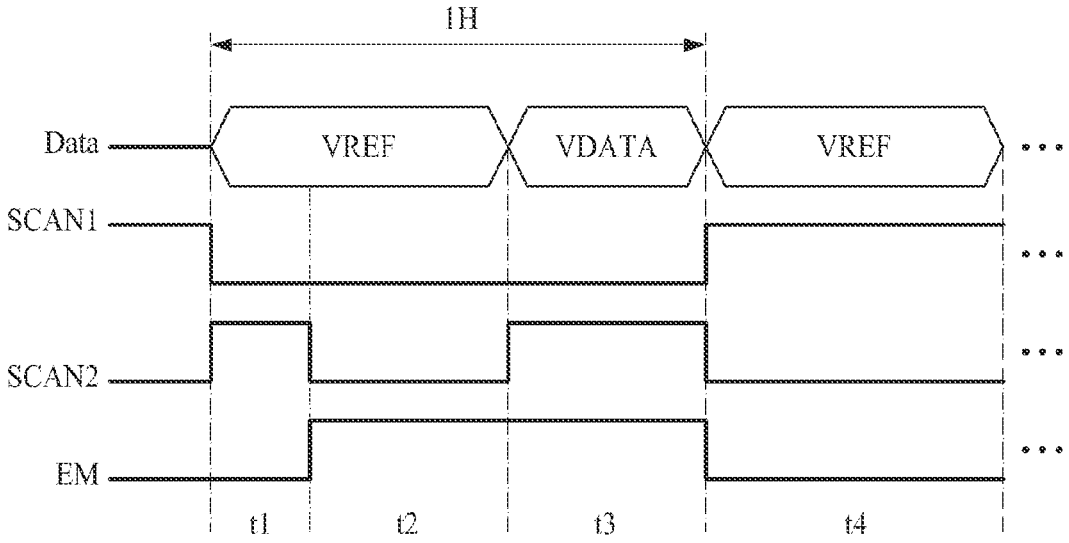
FIG. 3 is a driving waveform diagram for describing a method of driving a pixel circuit according to a first embodiment of the present invention.

FIG. 3 is a driving waveform diagram for describing a method of driving a pixel circuit according to a first embodiment of the present invention, and FIGS. 4A to 4D are diagrams illustrating operating states of the pixel circuit of FIG. 3 during respective periods. The method of driving a pixel circuit according to the first embodiment of the present invention will now be described with reference to FIGS. 3 and 4A to 4D.

The method of driving a pixel circuit according to the first embodiment of the present invention, as illustrated in FIG. 3, is separately executed during an initialization period t1, a threshold voltage storage period t2, a data voltage storage period t3, and an emission period t4.

In the method of driving a pixel circuit according to the first embodiment of the present invention, the first switching control signal is a first scan signal SCAN1, the second switching control signal is a second scan signal SCAN2, and the third switching control signal is an emission signal EM.

The method of driving a pixel circuit according to the first embodiment of the present invention is executed in the pixel circuit according to an embodiment of the present invention illustrated in FIG. 2

Figure 4A:
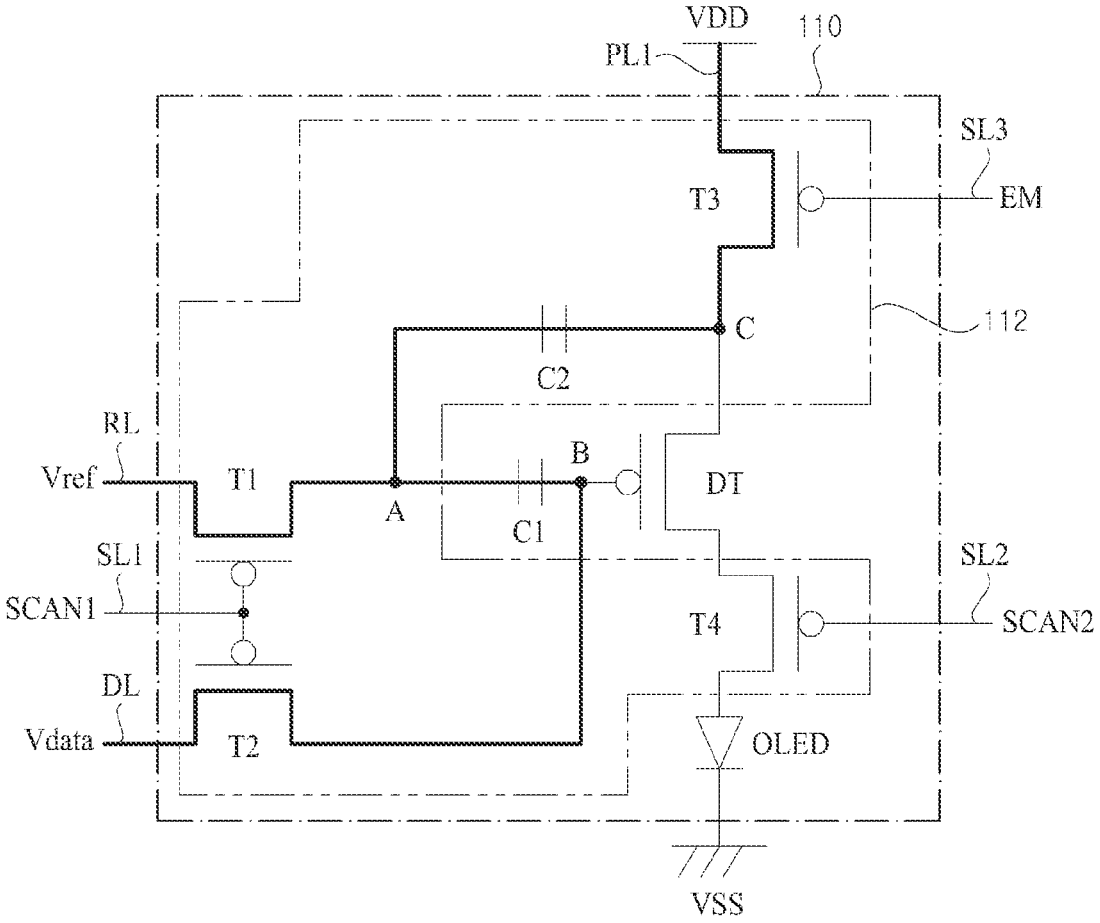
FIGS. 4A to 4D are diagrams illustrating operating states of the pixel circuit of FIG. 3 during respective periods.

First, as illustrated in FIGS. 3 and 4A, during the initialization period t1, the first switching control signal SCAN1 and the third switching control signal EM are driven to a low level, the second switching control signal SCAN2 is driven to a high level, and the reference voltage Vref is applied to the data line DL. That is, the reference voltage Vref is applied to the data line DL and the reference line RL.

By the signals, the reference voltage Vref is applied to the first and second switching transistors T1 and T2, and the driving voltage VDD is applied to the third switching transistor T3.

The fourth switching transistor T4 is turned off (opened) by the second switching control signal SCAN2, and thus, the light emitting element OLED does not emit light. Accordingly, a leakage current (C/R) can be effectively prevented.

Therefore, the first node A and the second node B are initialized to the reference voltage Vref, and the third node C is initialized to the driving voltage VDD.

At this time, the assistant capacitor C2 is initialized to "VDD−Vref" by a difference between the third node C and the first node A, and the data capacitor C1 is initialized to 0 by a difference between the first node A and the second node B.

Figure 4B:
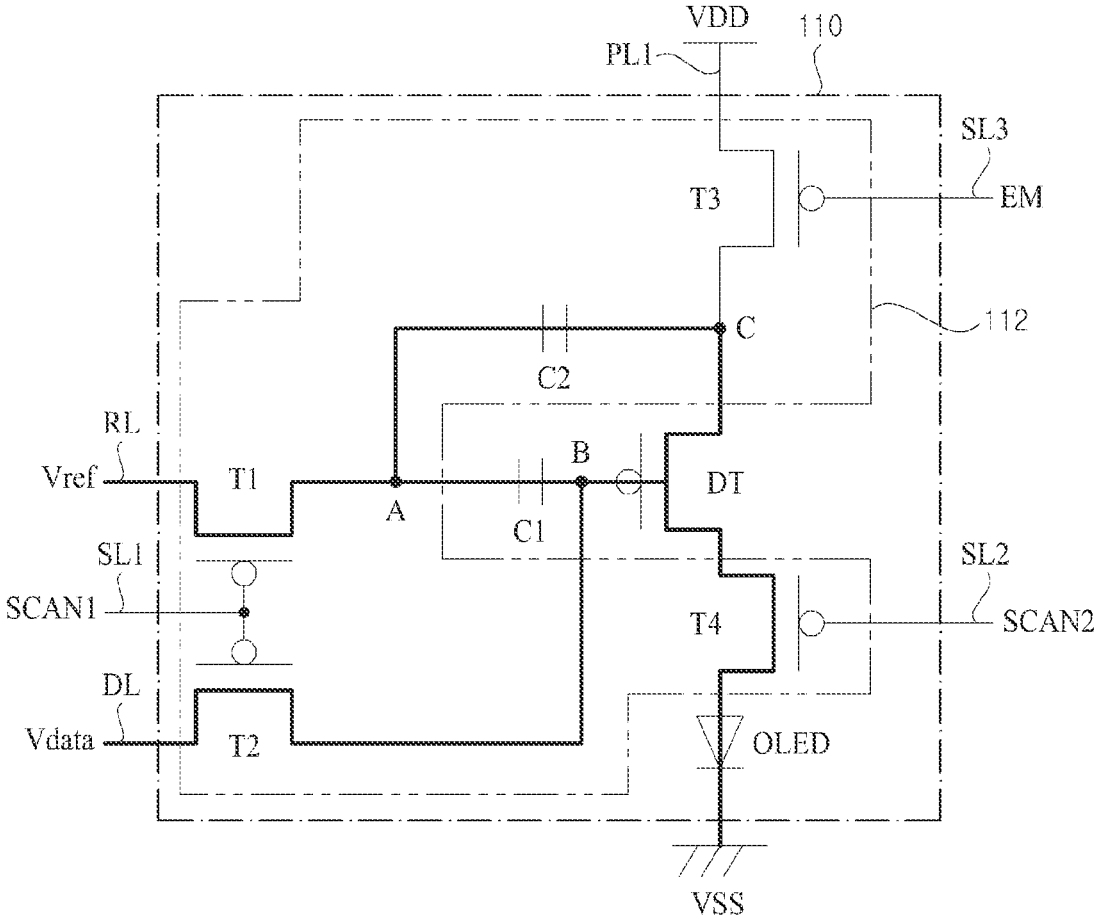

Subsequently, as illustrated in FIGS. 3 and 4B during the threshold voltage storage period t2, the third switching control signal EM is driven to a high level, the first switching control signal SCAN1 and the second switching control signal SCAN2 are driven to a low level, and the reference voltage Vref is applied to the data line DL. That is, the reference voltage Vref is applied to the data line DL and the reference line RL.

By the signals, the third switching transistor T3 is opened to float the third node C, and the reference voltage Vref is input through the first and second switching transistors T1 and T2.

Therefore, the first node A and the second node B are maintained at the reference voltage Vref, and by a source follower type connection, the third node C has a voltage higher than that of the second node B by the threshold voltage Vth of the driving transistor DT. That is, "Vref+|Vth|" is input to the third node C.

At this time, the threshold voltage Vth of the driving transistor DT is stored in the assistant capacitor C2 by a difference between the third node C and the first node A, and the data capacitor C1 is maintained at 0 V by a difference between the first node A and the second node B.

Figure 4C:
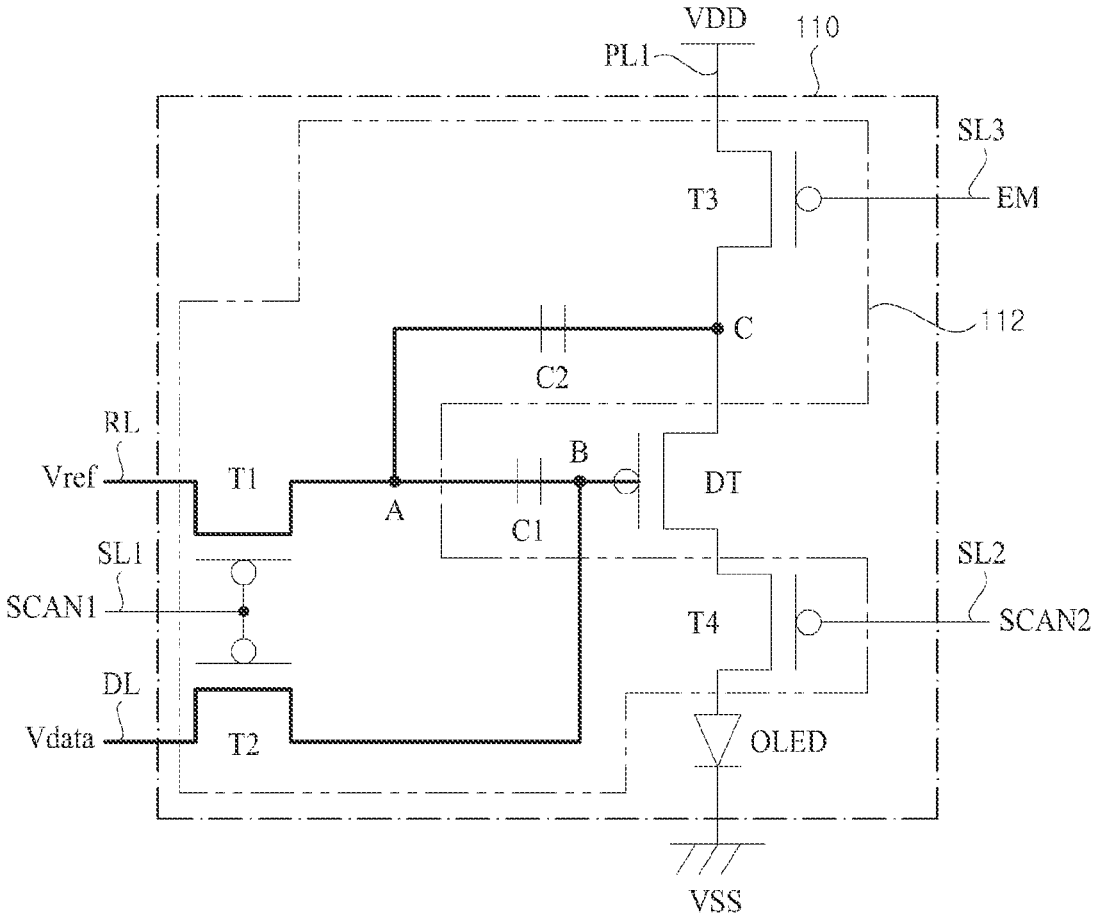

Subsequently, as illustrated in FIGS. 3 and 4C, during the data voltage storage period t3, the third switching control signal EM and the second switching control signal SCAN2 are driven to a high level, the first switching control signal SCAN1 is driven to a low level, and the data voltage Vdata is applied to the data line DL.

By the signals, the third switching transistor T3 and the fourth switching transistor T4 are opened, the reference voltage Vref is input through the first switching transistor T1, and the data voltage Vdata is input through the second switching transistor T2.

Therefore, the first node A is maintained at the reference voltage Vref, and thus, the third node C is also maintained at "Vref+|Vth|".

A voltage of the second node B is changed from the reference voltage Vref to the data voltage Vdata.

At this time, the assistant capacitor C2 is maintained at the threshold voltage Vth, and "Vref−Vdata" is stored in the data capacitor C1 by a difference between the first node A and the second node B.

Figure 4D:
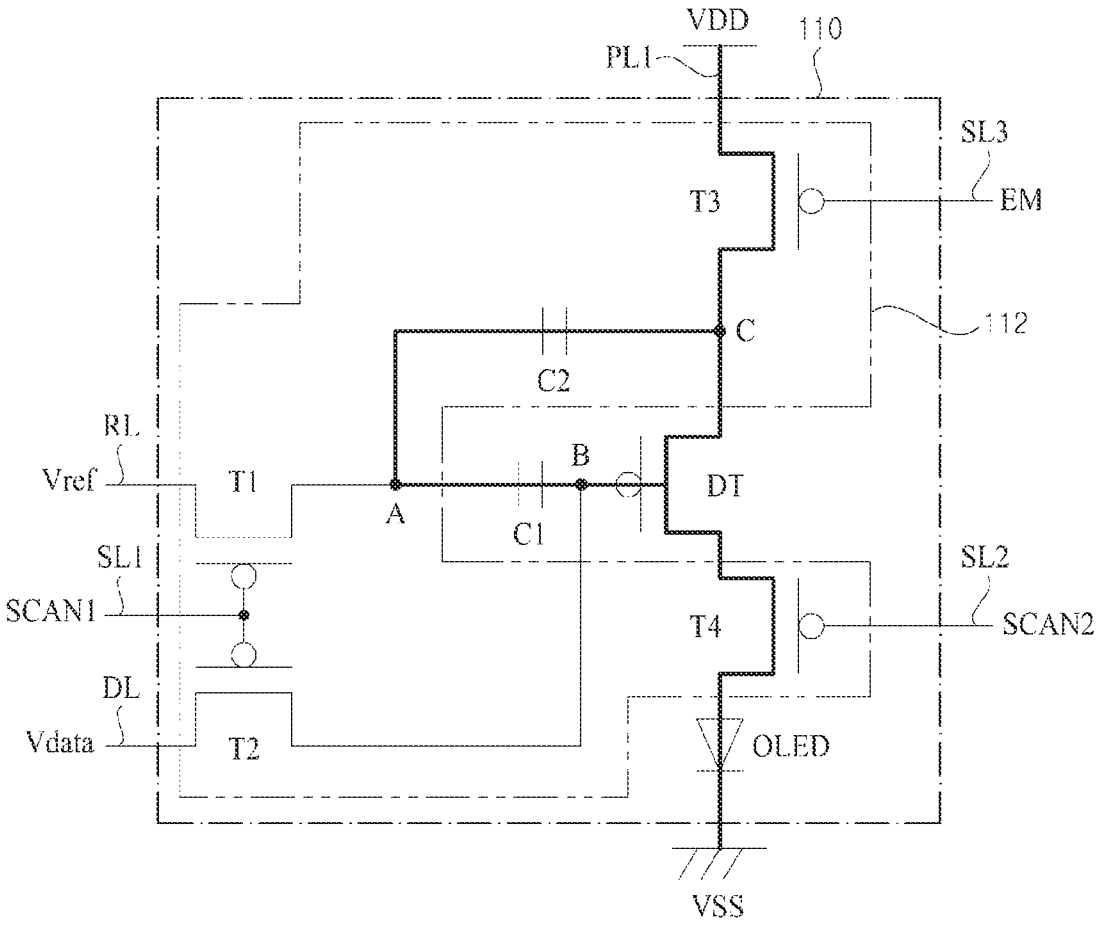

Finally, as illustrated in FIGS. 3 and 4D, during the emission period t4, the third switching control signal EM and the second switching control signal SCAN1 are driven to a low level, and the first switching control signal SCAN1 is driven to a high level.

By the signals, the first switching transistor T1 and the second switching transistor T2 are opened, and the driving voltage is input through the third switching transistor T3.

Therefore, the current Ioled flowing in the light emitting element OLED is controlled by a voltage Vgs applied across the gate and source of the driving transistor DT.

The voltage Vgs applied across the source and the gate is "Vref−Vdata+|Vth|" that is the sum of voltages respectively stored in the data capacitor C1 and the assistant capacitor C2.

In this case, a current which flows in the light emitting element OLED through the driving transistor DT is expressed as Equation (1):

$$I_{oled} = K\left(\frac{W}{L}\right)\times(Vref - Vdata)^2 \tag{1}$$

As expressed in Equation (1), the current flowing in the light emitting element OLED depends on only a difference between the reference voltage Vref and the data voltage Vdata.

Therefore, even though the threshold voltage Vth of the driving transistor DT is changed, an intensity of the current flowing in the light emitting element OLED is not changed.

Moreover, the data capacitor C1 and the assistant capacitor C2 are connected between the driving voltage VDD terminal and the gate, and thus, a voltage between the gate and the source is maintained without any change. Therefore, even when the driving voltage VDD is dropped by IR drop, the intensity of the current flowing in the light emitting element OLED is not changed.

In Equation (1), K is a proportional constant, and is a value which is determined by a structure and physical characteristic of the driving transistor DT. Thus, K may be determined by a mobility of the driving transistor DT and a ratio "W/L" of a channel width W and a channel length L of the driving transistor DT.

As described above in the background art, the threshold voltage Vth of the driving transistor DT does not always have a constant value, and a threshold voltage deviation can be caused by an operating state of the driving transistor DT.

However, as seen in Equation (1), in the pixel circuit 110 according to the first embodiment of the present invention, an equation for calculating the current Ioled flowing in the light emitting element OLED does not consider the threshold voltage Vth and the driving voltage VDD of the driving transistor DT. Therefore, during the emission period t4, the current Ioled flowing in the light emitting element OLED does not depend on the threshold voltage Vth of the driving transistor DT and the driving voltage VDD, and is determined by a difference between the data voltage Vdata and the reference voltage Vref.

The pixel circuit 110 and the driving method thereof according to the first embodiment of the present invention remove an influence of the threshold voltage Vth based on an operating state of the driving transistor DT and an influence of a drop of the driving voltage VDD caused by a resistance of the driving voltage supply line PL, thus preventing a quality of an image from being degraded by the threshold voltage Vth deviation of the driving transistor DT and the drop of the driving voltage VDD.

Figure 5:
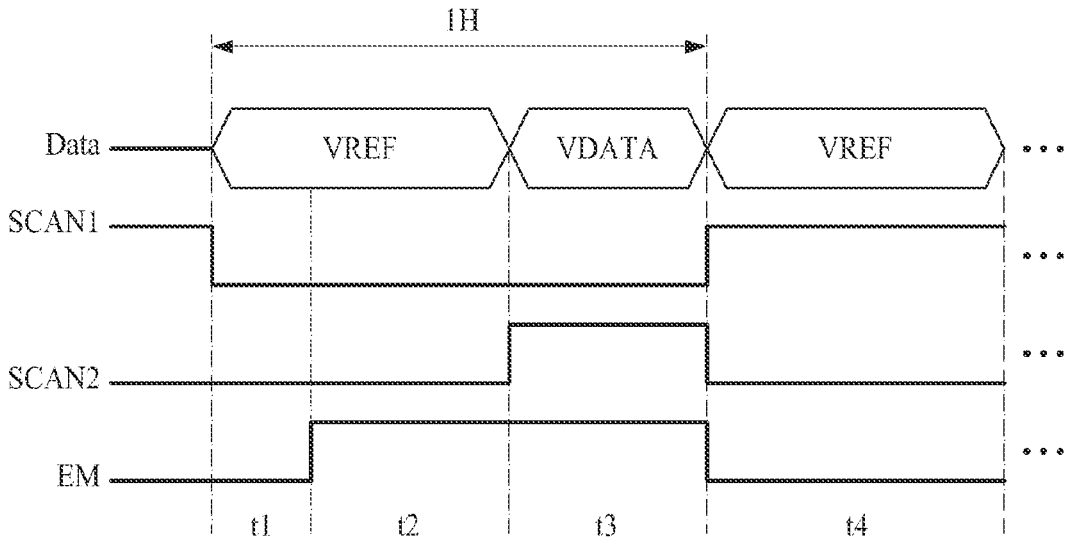
FIG. 5 is a driving waveform diagram for describing a method of driving a pixel circuit according to a second embodiment of the present invention.

FIG. 5 is a driving waveform diagram for describing a method of driving a pixel circuit according to a second embodiment of the present invention, and FIGS. 6A to 6D are diagrams illustrating operating states of the pixel circuit of FIG. 5 during respective periods. The method of driving a pixel circuit according to the second embodiment of the present invention will now be described with reference to FIGS. 5 and 6A to 6D.

A pixel circuit 110 according to a second embodiment of the present invention includes a light emitting element OLED, a driving transistor DT, a data capacitor C1, and a switching unit 112. The elements of the pixel circuit 110 according to the second embodiment of the present invention are the same as those of the pixel circuit according to the first embodiment illustrated in FIG. 2.

Thus, only the method of driving a pixel circuit according to the second embodiment of the present invention will be described below.

The method of driving a pixel circuit according to the second embodiment of the present invention, as illustrated in FIG. 5, is separately executed during an initialization period t1, a threshold voltage storage period t2, a data voltage storage period t3, and an emission period t4.

In the method of driving a pixel circuit according to the second embodiment of the present invention, the first switching control signal is the first scan signal SCAN1, the second switching control signal is the second scan signal SCAN2, and the third switching control signal is the emission signal EM.

Figure 6A:
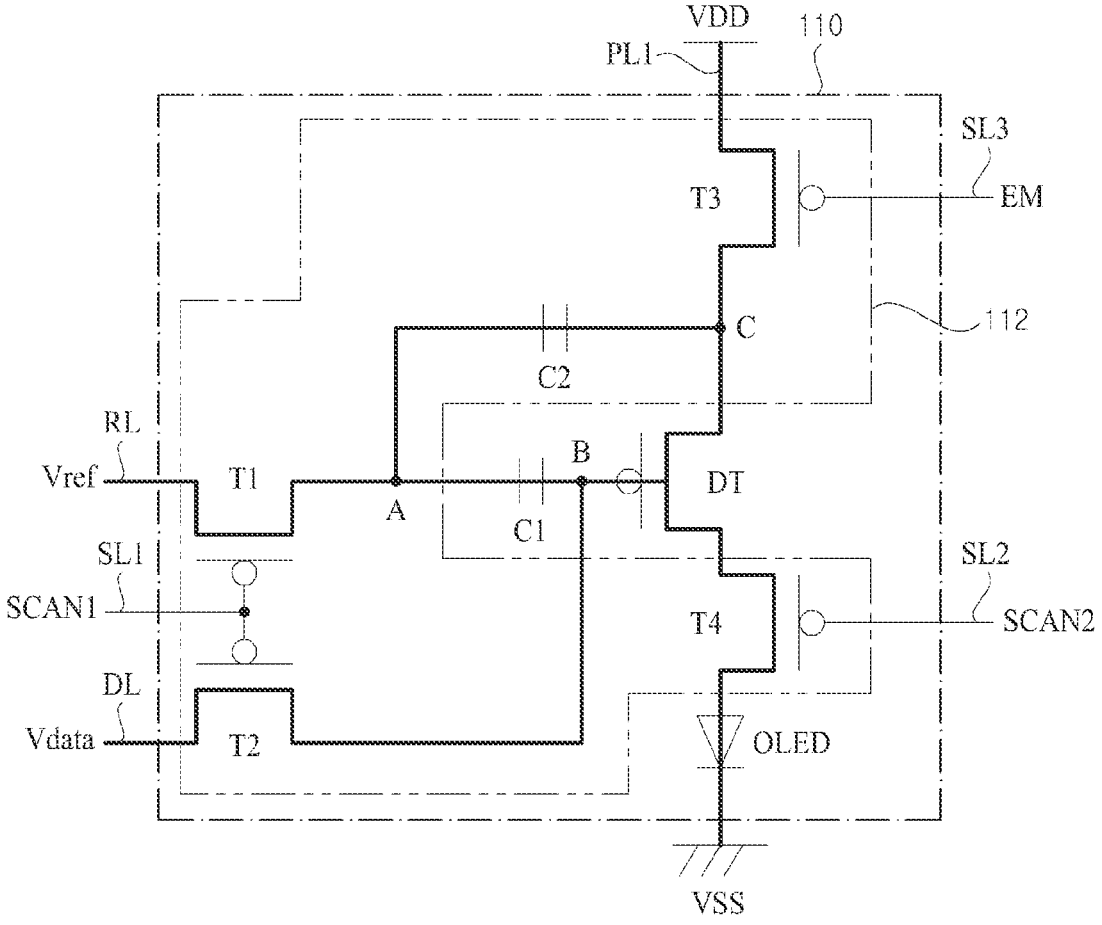
FIGS. 6A to 6D are diagrams illustrating operating states of the pixel circuit of FIG. 5 during respective periods.

First, as illustrated in FIGS. 5 and 6A, during the initialization period t1, the first switching control signal SCAN1, the second switching control signal SCAN2, and the third switching control signal EM are all driven to a low level, and the reference voltage Vref is applied to the data line DL. That is, the reference voltage Vref is applied to the data line DL and the reference line RL.

By the signals, the reference voltage Vref and v driving voltage VDD are input through the first to third switching transistors T1 to T3.

Therefore, the first node A and v second node B are initialized to the reference voltage Vref, and the third node C is initialized to the driving voltage VDD.

At this time, the assistant capacitor C2 is initialized to "VDD−Vref" by a difference between the third node C and the first node A, and the data capacitor C1 is initialized to 0 by a difference between the first node A and the second node B.

Figure 6B:
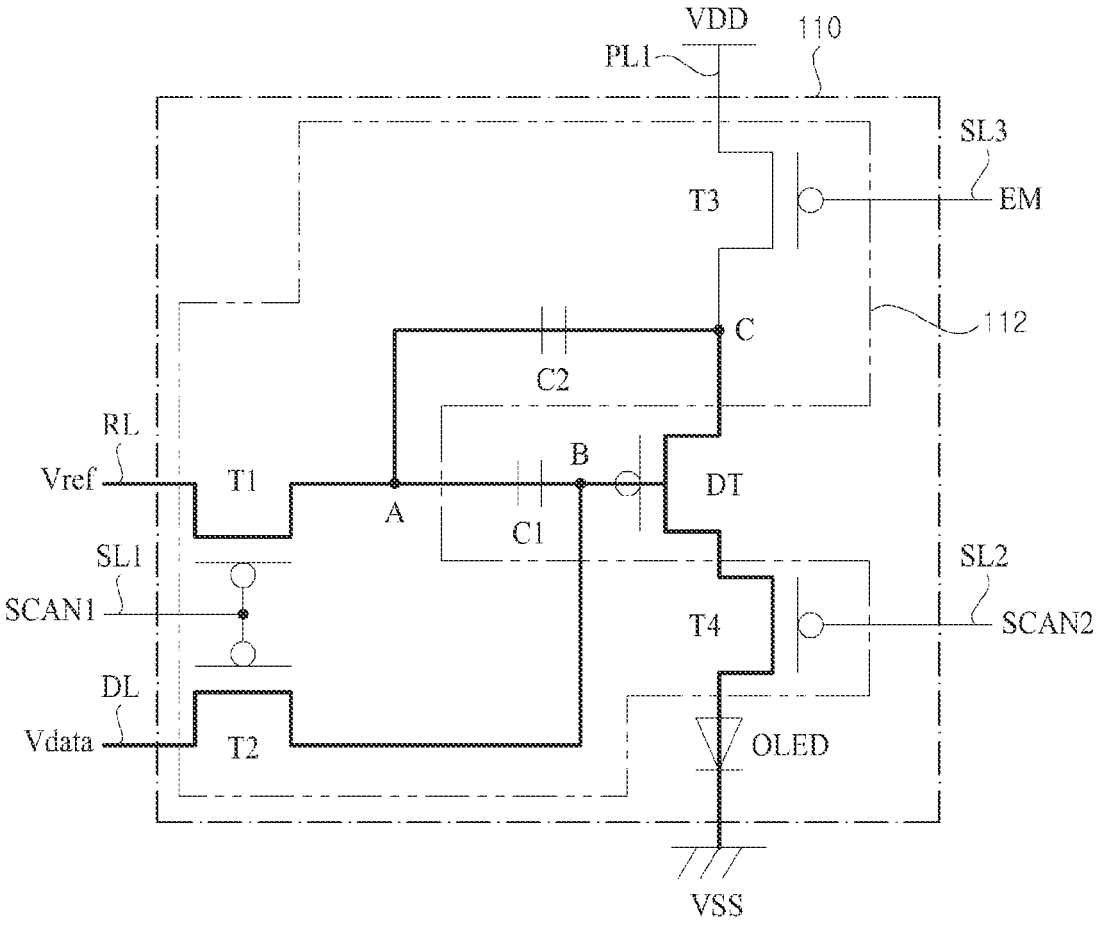

Subsequently, as illustrated in FIGS. 5 and 6B, during the threshold voltage storage period t2, the third switching control signal EM is driven to a high level, the first switching control signal SCAN1 and the second switching control signal SCAN2 are driven to a low level, and the reference voltage Vref is applied to the data line DL.

By the signals, the third switching transistor T3 is opened to float the third node C, and the reference voltage Vref is input through the first and second switching transistors T1 and T2.

Therefore, the first node A and the second node B are maintained at the reference voltage Vref, and by the source follower type connection, the third node C has a voltage higher than that of the second node B by the threshold voltage Vth of the driving transistor DT. That is, "Vref+|Vth|" is input to the third node C.

At this time, the threshold voltage Vth of the driving transistor DT is stored in the assistant capacitor C2 by a difference between the third node C and the first node A, and the data capacitor C1 is maintained at 0 V by a difference between the first node A and the second node B.

Figure 6C:
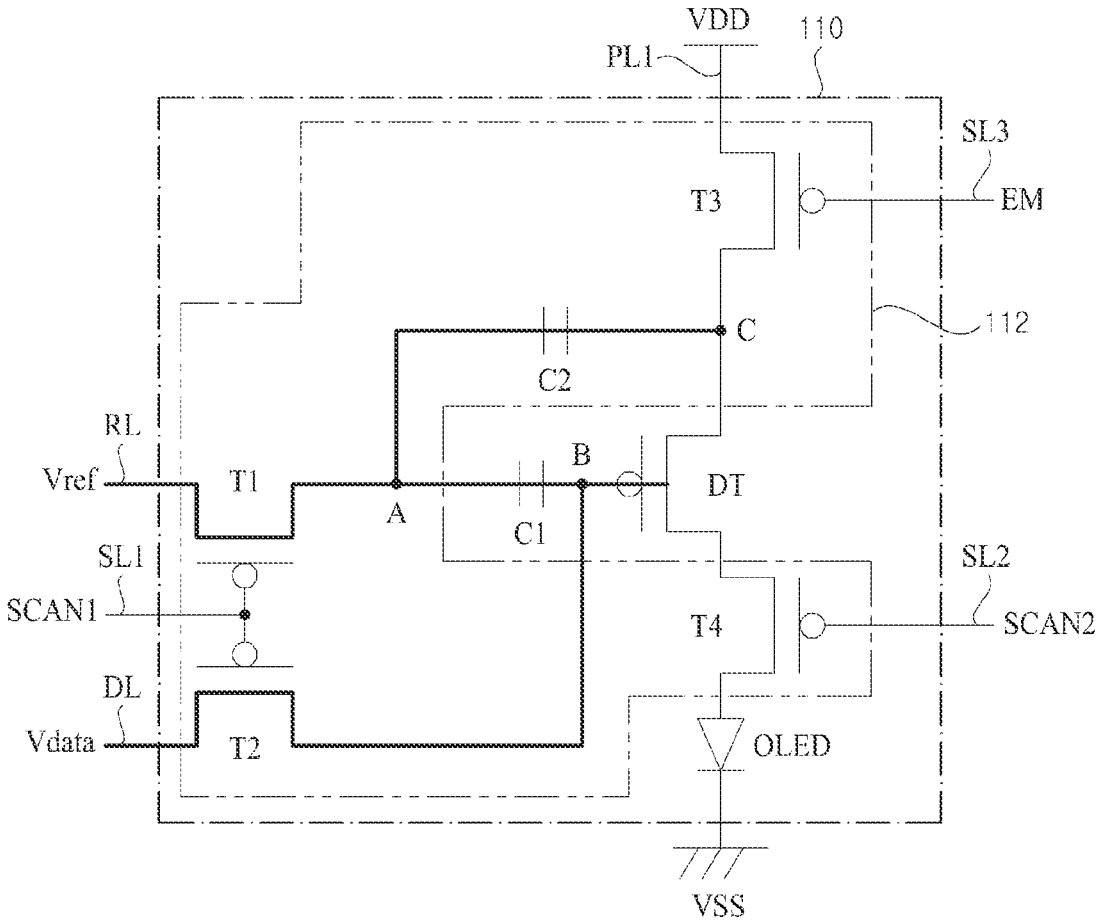

Subsequently, as illustrated in FIGS. 5 and 6C, during the data voltage storage period t3, the third switching control signal EM and the second switching control signal SCAN2 are driven to a high level, the first switching control signal SCAN1 is driven to a low level, and the data voltage Vdata is applied to the data line DL.

By the signals, the third switching transistor T3 and the fourth switching transistor T4 are opened, the reference voltage Vref is input through the first switching transistor T1, and the data voltage Vdata is input through the second switching transistor T2.

Therefore, the first node A is maintained at the reference voltage Vref, and thus, the third node C is also maintained at "Vref+|Vth|".

A voltage of the second node B is changed from the reference voltage Vref to the data voltage Vdata.

At this time, the assistant capacitor C2 is maintained at the threshold voltage Vth, and "Vref−Vdata" is stored in the data capacitor C1 by a difference between the first node A and the second node B.

Figure 6D:
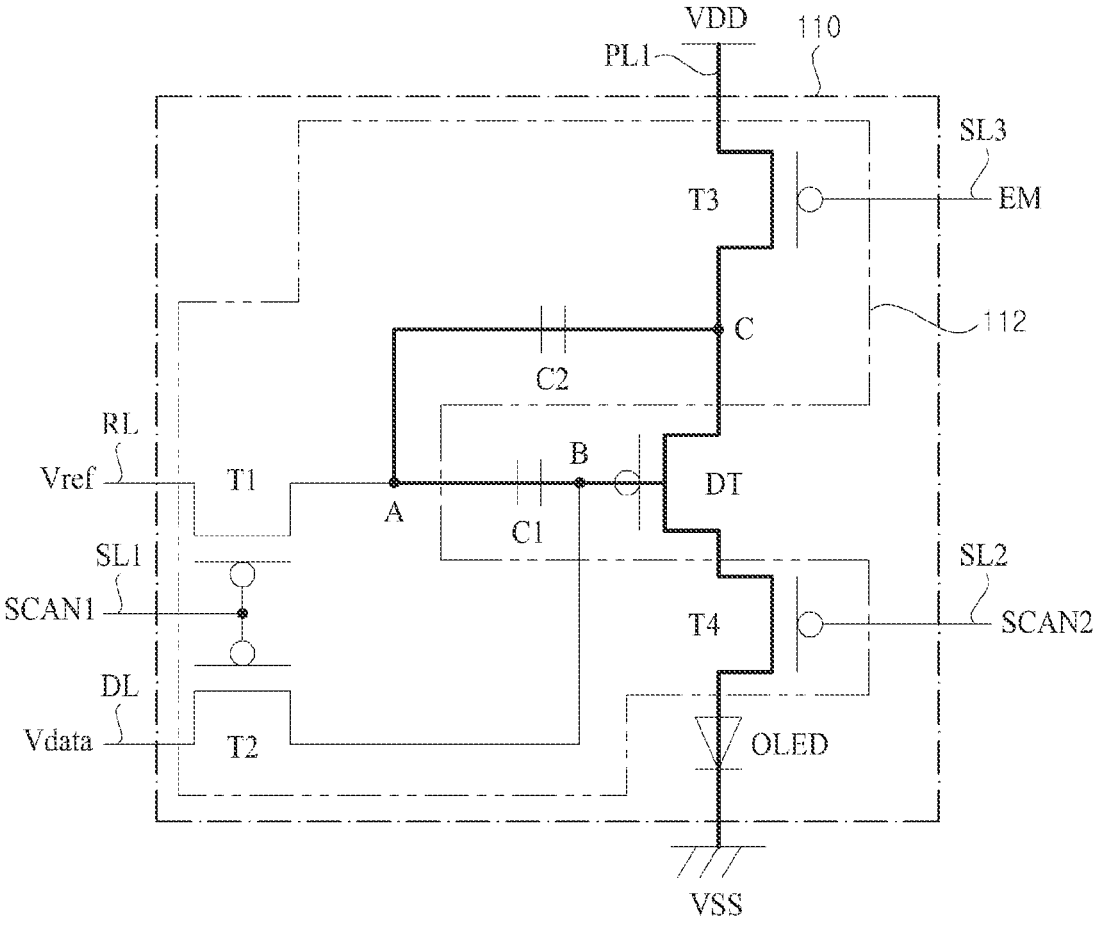

Finally, as illustrated in FIGS. 5 and 6D, during the emission period t4, the third switching control signal EM and the second switching control signal SCAN1 are driven to a low level, and the first switching control signal SCAN1 is driven to a high level.

By the signals, the first switching transistor T1 and the second switching transistor T2 are opened, and the driving voltage is input through the third switching transistor T3.

Therefore, the current Ioled flowing in the light emitting element OLED is controlled by a voltage Vgs applied across the gate and source of the driving transistor DT.

The voltage Vgs applied across the source and the gate is "Vref−Vdata+|Vth|" that is the sum of voltages respectively stored in the data capacitor C1 and the assistant capacitor C2.

In this case, a current which flows in the light emitting element OLED through the driving transistor DT is expressed as Equation (1).

As expressed in Equation (1), the current flowing in the light emitting element OLED depends on only a difference between the reference voltage Vref and the data voltage Vdata.

Therefore, even though the threshold voltage Vth of the driving transistor DT is changed, an intensity of the current flowing in the light emitting element OLED is not changed.

Moreover, the data capacitor C1 and the assistant capacitor C2 are connected between the driving voltage VDD terminal and the gate, and thus, a voltage between the gate and the source is maintained without any change. Therefore, even when the driving voltage VDD is dropped by IR drop, the intensity of the current flowing in the light emitting element OLED is not changed.

Except that the fourth switching transistor T4 is turned off during the initialization period t1, the above-described second embodiment of the present invention has the same configuration, function, and effect as those of the first embodiment of the present invention.

Figure 7:
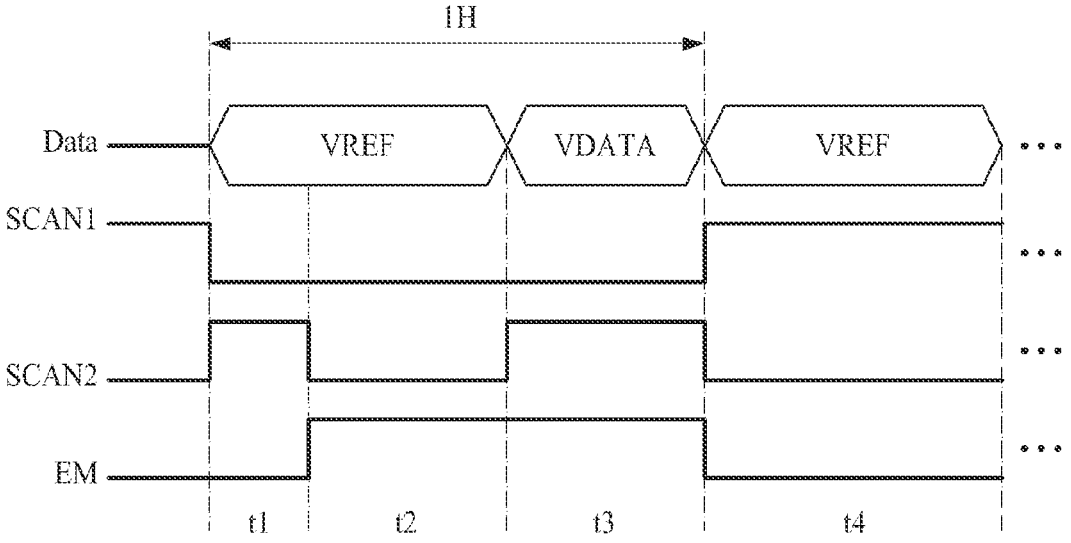
FIG. 7 is a driving waveform diagram for describing a method of driving a pixel circuit according to a third embodiment of the present invention.

FIG. 7 is a driving waveform diagram for describing a method of driving a pixel circuit according to a third embodiment of the present invention, and FIGS. 8A to 8D are diagrams illustrating operating states of the pixel circuit of FIG. 7 during respective periods. The method of driving a pixel circuit according to the third embodiment of the present invention will now be described with reference to FIGS. 7 and 8A to 8D.

A pixel circuit 110 according to a third embodiment of the present invention includes a light emitting element OLED, a driving transistor DT, a data capacitor C1, and a switching unit 112. The elements of the pixel circuit 110 according to the third embodiment of the present invention are the same as those of the pixel circuit according to the first embodiment illustrated in FIG. 2.

Thus, only the method of driving a pixel circuit according to the third embodiment of the present invention will be described below.

The method of driving a pixel circuit according to the third embodiment of the present invention, as illustrated in FIG. 7, is separately executed during an initialization period t1, a threshold voltage storage period t2, a data voltage storage period t3, and an emission period t4.

In the method of driving a pixel circuit according to the third embodiment of the present invention, the first switching control signal is the first scan signal SCAN1, the second switching control signal is the second scan signal SCAN2, and the third switching control signal is the emission signal EM.

Figure 8A:
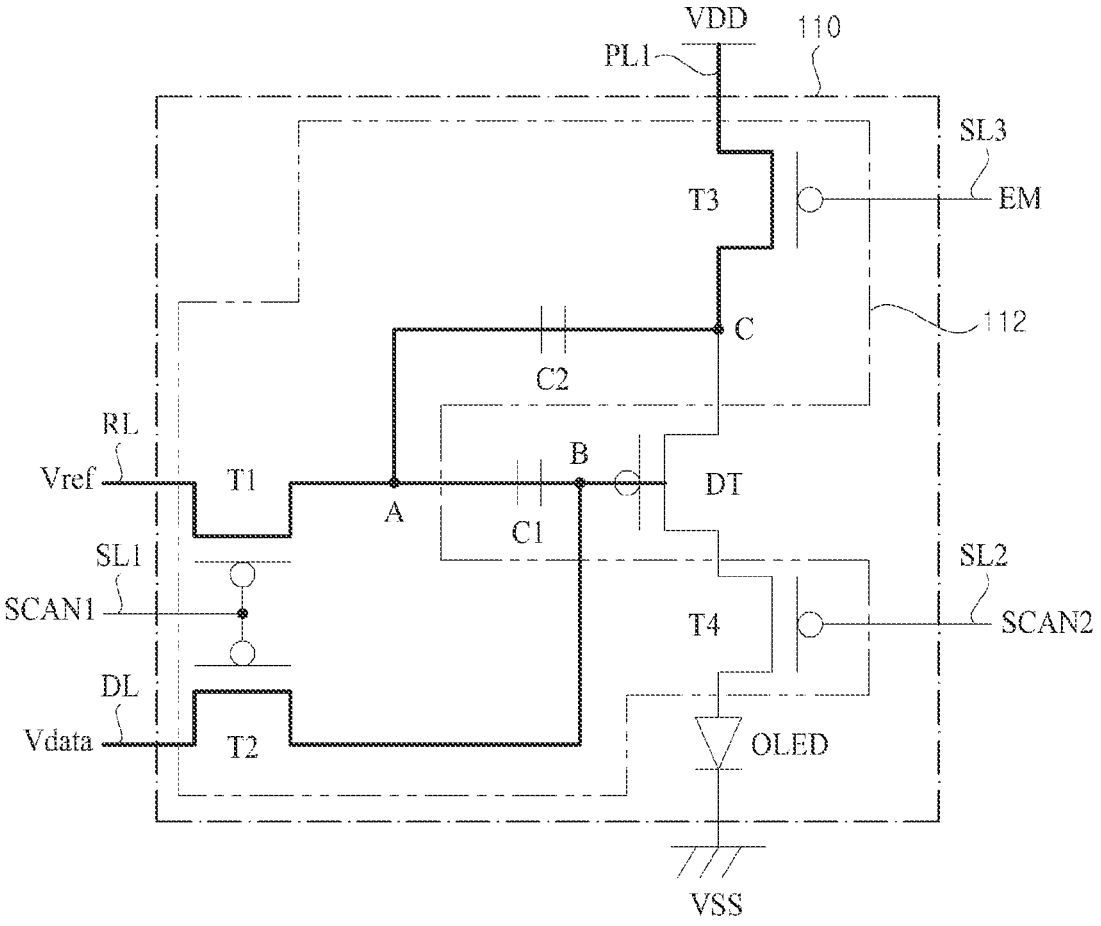
FIGS. 8A to 8D are diagrams illustrating operating states of the pixel circuit of FIG. 7 during respective periods.

First, as illustrated in FIGS. 7 and 8A, during the initialization period t1, the first switching control signal SCAN1 and the third switching control signal EM are driven to a low level, the second switching control signal SCAN2 is driven to a high level.

The reference voltage Vref is applied to the data line DL.

By the signals, the reference voltage Vref and v driving voltage VDD are input through the first to third switching transistors T1 to T3.

At this time, the fourth switching transistor T4 is opened, and thus, the light emitting element OLED does not emit light.

Therefore, the first node A and v second node B are initialized to the reference voltage Vref, and the third node C is initialized to the driving voltage VDD.

At this time, the assistant capacitor C2 is initialized to "VDD−Vref" by a difference between the third node C and the first node A, and the data capacitor C1 is initialized to 0 by a difference between the first node A and the second node B.

Figure 8B:
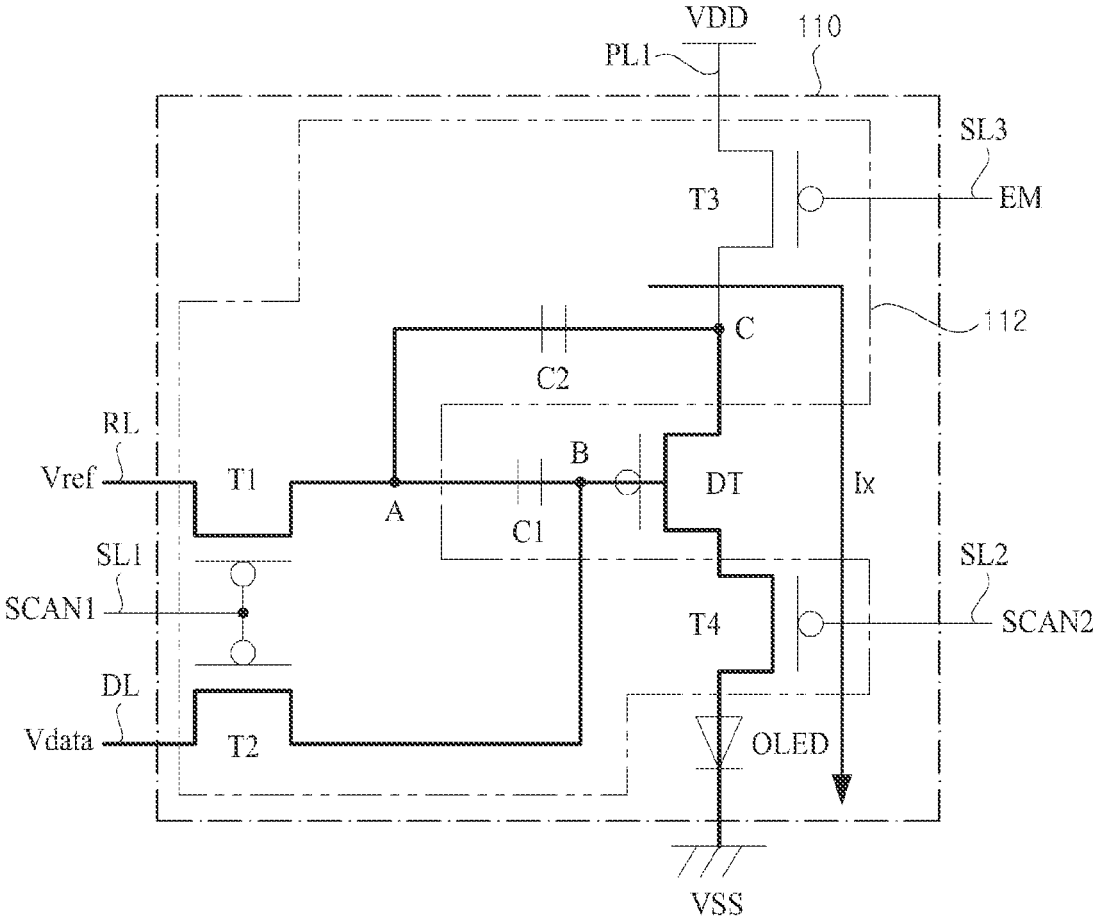

Subsequently, as illustrated in FIGS. 7 and 8B, during the threshold voltage storage period t2, the third switching control signal EM is driven to a high level, the first switching control signal SCAN1 and the second switching control signal SCAN2 are driven to a low level, and the reference voltage Vref is applied to the data line DL.

By the signals, the third switching transistor T3 is opened to float the third node C, and the reference voltage Vref is input through the first and second switching transistors T1 and T2.

Therefore, the first node A and the second node B are maintained at the reference voltage Vref, and by the source follower type connection, a current flows through the driving transistor DT, the fourth switching transistor T4, and the light emitting element OLED. A voltage of the third node C is determined with the current. When the current is Ix, the current is calculated as expressed in Equation (2):

$$I_x = \frac{1}{2}k\mu(V_x - |V_{th}|)^2 \quad \left(k = \frac{W}{L}C_{ox}\right) \tag{2}$$

where Vx denotes a voltage associated with a mobility of the driving transistor DT, and hereinafter is simply referred to as a mobility voltage Vx. Vx is calculated as expressed in the following Equation (3):

$$V_x = \sqrt{\frac{2I_x}{ku}} + |V_{th}| \tag{3}$$

In the third embodiment of the present invention, before the mobility voltage Vx is dropped to the threshold voltage Vth, a width of the threshold voltage storage period t2 may be adjusted such that a current 1*x* flowing to the light emitting element OLED is matched between different pixels.

"Vref+Vx" is input to the third node C.

At this time, the mobility voltage Vx is stored in the assistant capacitor C2 by a difference between the third node C and the first node A, and the data capacitor C1 is maintained at 0 V by a difference between the first node A and the second node B.

In Equations (2) and (3), it can be seen that the mobility voltage Vx includes the threshold voltage Vth and mobility "μ" of the driving transistor DT.

Figure 8C:
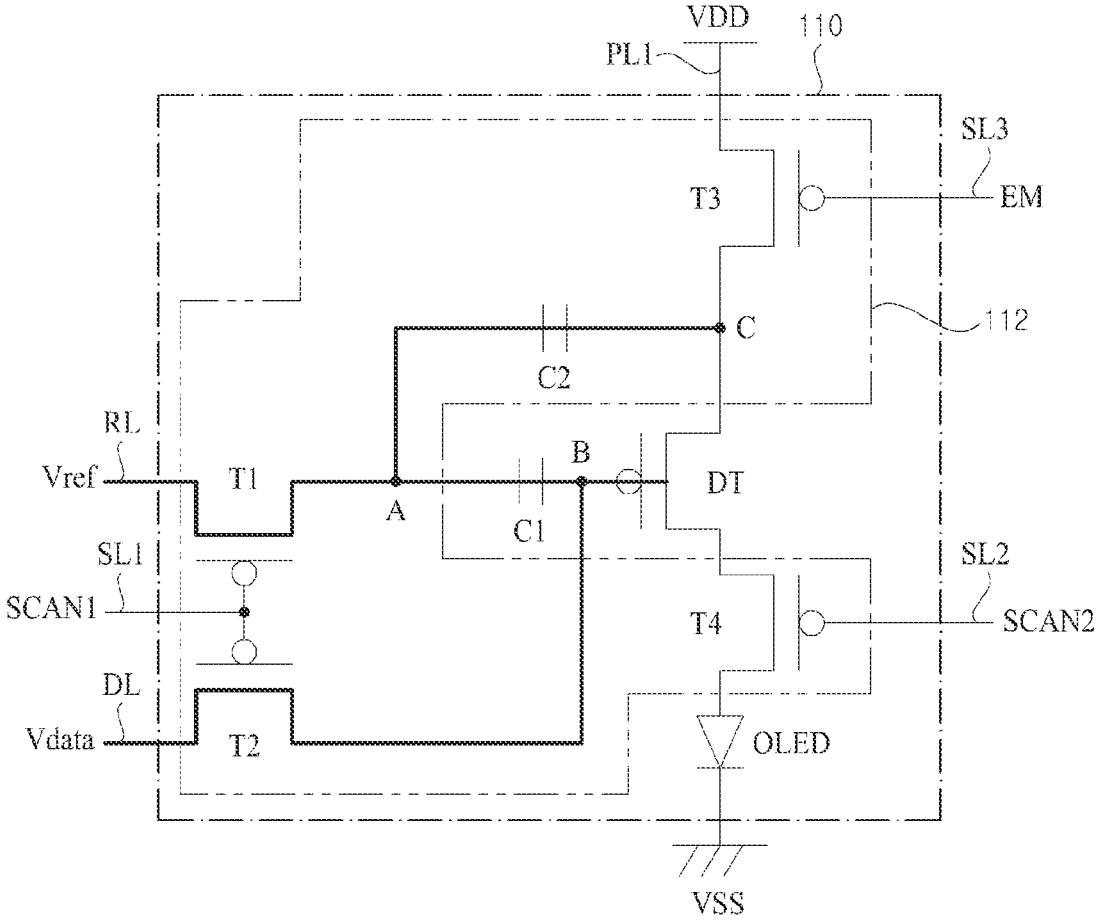

Subsequently, as illustrated in FIGS. 7 and 8C, during the data voltage storage period t3, the third switching control signal EM and the second switching control signal SCAN2 are driven to a high level, the first switching control signal SCAN1 is driven to a low level.

The data voltage Vdata is applied to the data line DL.

By the signals, the third switching transistor T3 and the fourth switching transistor T4 are opened, the reference voltage Vref is input through the first switching transistor T1, and the data voltage Vdata is input through the second switching transistor T2.

Therefore, the first node A is maintained at the reference voltage Vref, and the third node C is also maintained at "Vref+Vx". A voltage of the second node B is changed from the reference voltage Vref to the data voltage Vdata.

At this time, the assistant capacitor C2 is maintained at the mobility voltage Vx, and "Vref−Vdata" is stored in the data capacitor C1 by a difference between the first node A and the second node B.

Figure 8D:
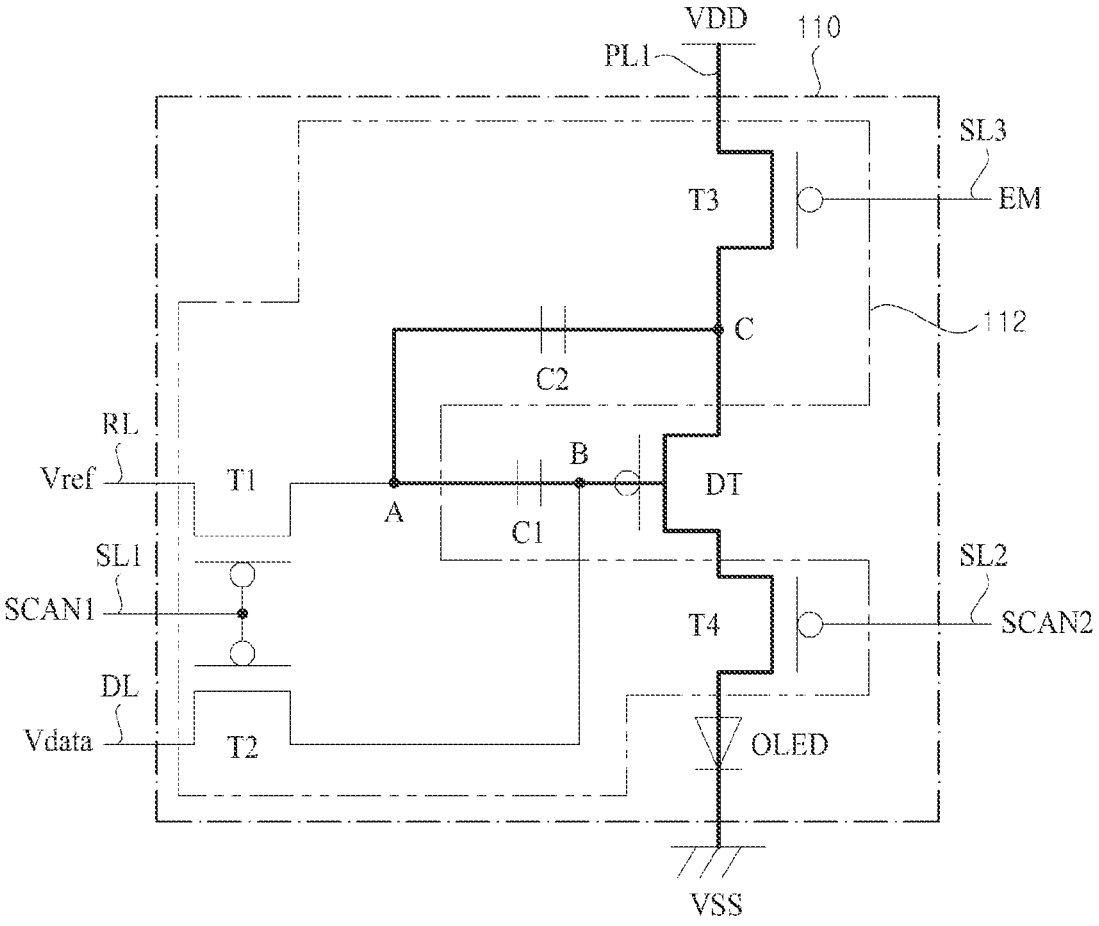

Finally, as illustrated in FIGS. 7 and 8D, during the emission period t4, the third switching control signal EM and the second switching control signal SCAN1 are driven to a low level, and the first switching control signal SCAN1 is driven to a high level.

By the signals, the first switching transistor T1 and the second switching transistor T2 are opened, and the driving voltage is input through the third switching transistor T3.

Therefore, the current Ioled is controlled by a voltage Vgs applied across the gate and source of the driving transistor DT.

The voltage Vgs applied across the source and the gate is "Vref−Vdata+Vx" that is the sum of voltages respectively stored in the data capacitor C1 and the assistant capacitor C2. That is, since Vx is stored in the assistant capacitor C2 and "Vref−Vdata" is stored in the data capacitor C1 during the data voltage storage period t3 as described above, during the emission period t4, the gate-source voltage Vgs of the driving transistor DT is "Vref−Vdata+Vx".

At this time, the current Ioled which flows in the light emitting element OLED through the driving transistor DT is expressed as the following Equation (4):

$$I_{oled} = \frac{1}{2}k\mu \times (Vref - Vdata + V_x - |Vth|)^2 \quad (4)$$

$$= \frac{1}{2}k\mu \times \left(Vref - Vdata + \sqrt{\frac{2I_x}{k\mu}}\right)^2 \quad \left(k = \frac{W}{L}C_{ox}\right)$$

Therefore, in the third embodiment of the present invention, the assistant capacitor C2 and the data capacitor C1 which are connected between the driving voltage VDD terminal and the gate of the driving transistor DT maintain a voltage between the gate and the source of the driving transistor DT, and thus, even when the driving voltage VDD is dropped due to the IR drop, the same current flows in the light emitting element OLED.

The pixel circuit 110 and the driving method thereof according to the third embodiment of the present invention remove an influence of the threshold voltage Vth based on an operating state of the driving transistor DT and an influence of a drop of the driving voltage VDD caused by a resistance of the driving voltage supply line PL, thus preventing a quality of an image from being degraded by the threshold voltage Vth deviation of the driving transistor DT and the drop of the driving voltage VDD.

Moreover, in the pixel circuit 110 and the driving method thereof according to the third embodiment of the present invention, as expressed in Equation (4), since the mobility of the driving transistor DT is set to a constant value, an influence of a mobility change of the driving transistor DT can be removed.

Figure 9:
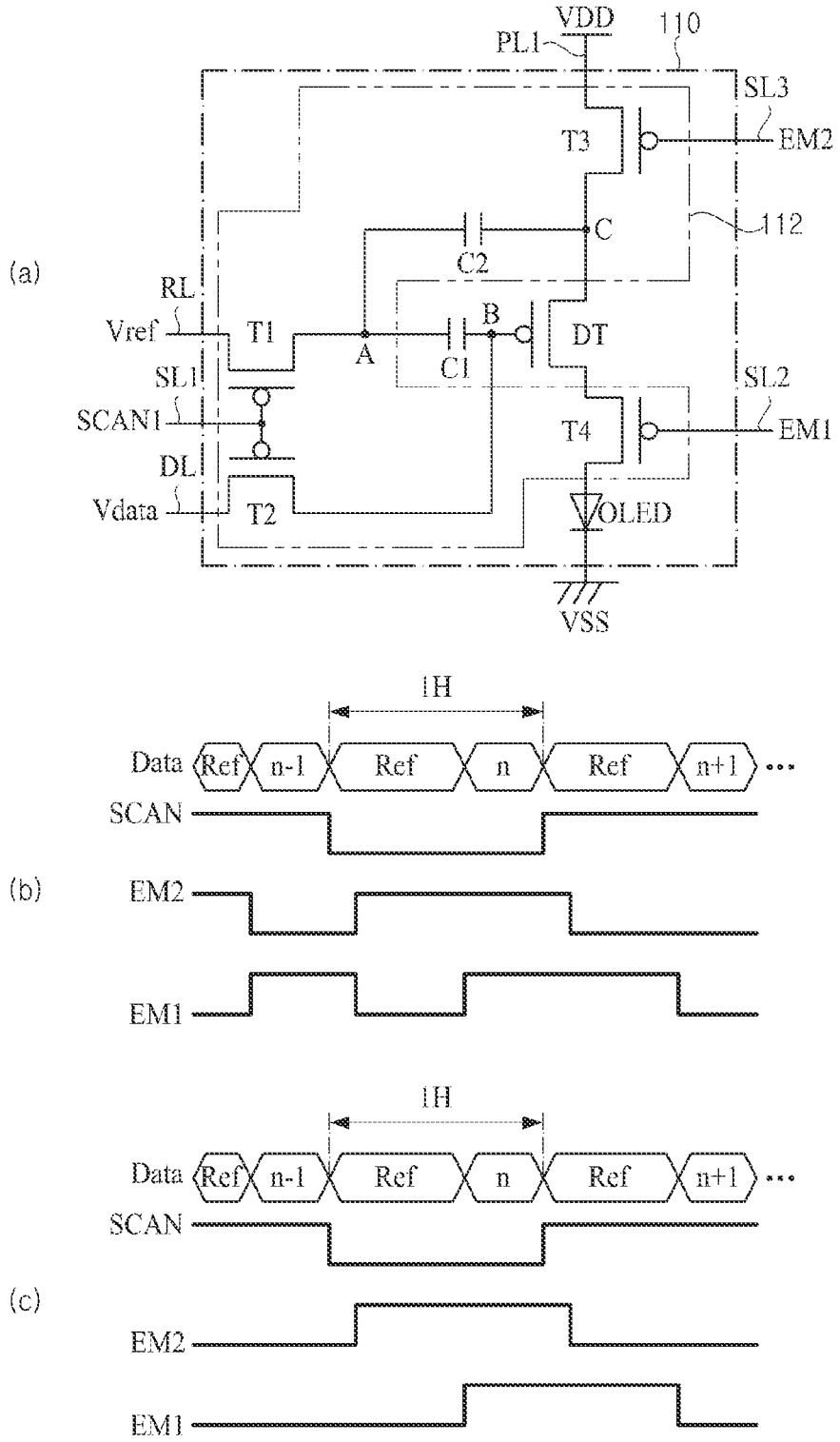
FIG. 9 is a circuit diagram schematically illustrating a pixel circuit according to another embodiment of the present invention.

FIG. 9 is a circuit diagram schematically illustrating a pixel circuit according to another embodiment of the present invention.

Except that kinds of the first to third switching control signals are changed, as illustrated in FIG. 9A, the pixel circuit according to another embodiment of the present invention has the same structure as that of the pixel circuit to an embodiment of the present invention illustrated in FIG. 2.

In the pixel circuit to an embodiment of the present invention illustrated in FIG. 2, the first scan signal SCAN1 is used as the first switching control signal, the second scan signal SCAN2 is used as the second switching control signal, and the emission signal EM is used as the third switching control signal.

On the other hand, in the pixel circuit according to another embodiment of the present invention illustrated in FIG. 9A, the first scan signal SCAN1 is used as the first switching control signal, a first emission signal EM1 is used as the second switching control signal, and a second emission signal EM2 is used as the third switching control signal.

By respectively using the first and second emission signals EM1 and EM2 as the second and third switching control signals, the pixel circuit according to another embodiment of the present invention illustrated in FIG. 9A may be driven as described above in the first to third embodiments of the present invention.

Therefore, the pixel circuit according to another embodiment of the present invention illustrated in FIG. 9A are driven by using the two emission signals EM1 and EM2, thus enabling signal lines to be efficiently used. That is, as shown waveform diagrams of FIGS. 9B and 9C, the pixel circuit according to another embodiment of the present invention illustrated in FIG. 9 are driven by the same method as the above-described method, and thus, the number of driving signals can be reduced. Accordingly, a gate driving integrated circuit (IC) that drives the pixel circuit can be efficiently configured.

Figure 10:
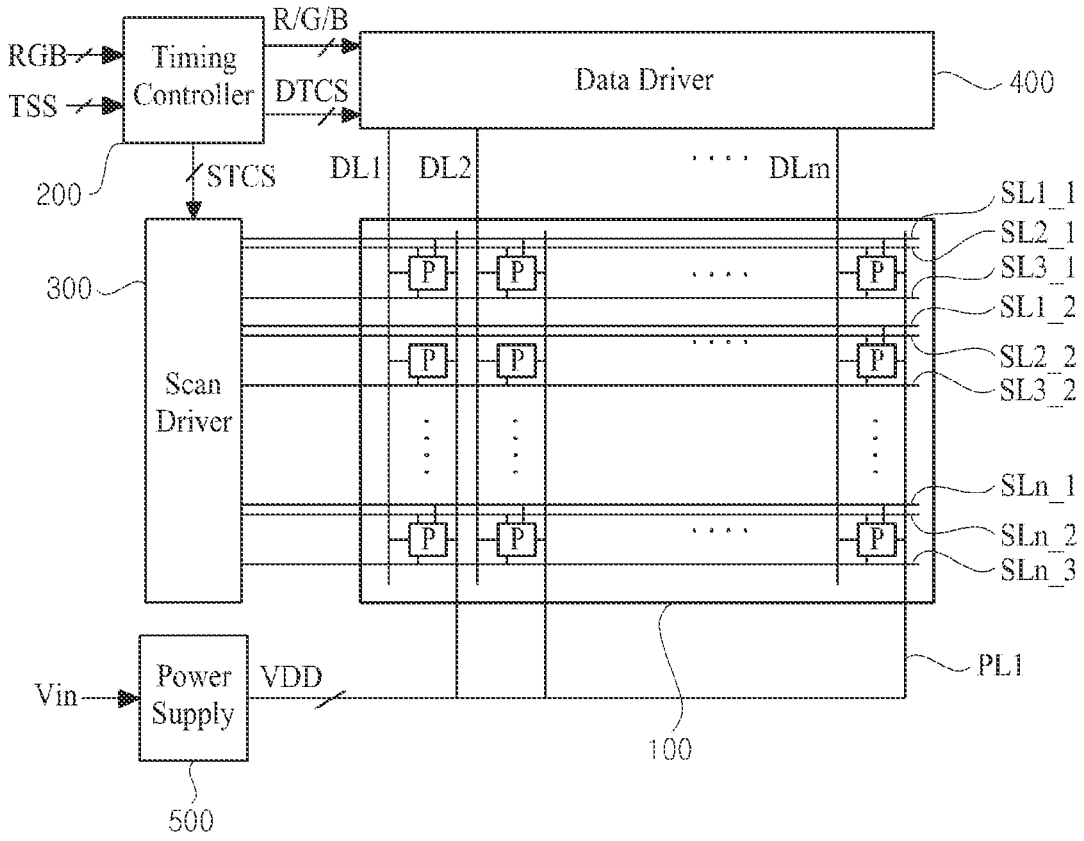
FIG. 10 is a diagram schematically illustrating an organic light emitting display device according to an embodiment of the present invention.

FIG. 10 is a diagram schematically illustrating an organic light emitting display device according to an embodiment of the present invention.

The organic light emitting display device according to an embodiment of the present invention, as illustrated in FIG. 10, includes a display panel 100, a timing controller 200, a scan driver 300, a data driver 400, and a power supply 500.

The display panel 100 includes a plurality of data lines DL1 to DLm, a plurality of scan line groups that each include first to third switching control signal supply lines SL1_*n*, SL2_*n* and SL3_*n* (where n is a natural number equal to or more than one), and a plurality of pixels P that are respectively formed in a plurality of pixel areas defined by a plurality of driving voltage supply lines PL.

Each of the plurality of pixels P includes the pixel circuit 110 according to an embodiment of the present invention which has been described above with reference to FIG. 2, and each pixel P on a corresponding horizontal line is driven by the method of driving the pixel circuit according to the present invention described above with reference to FIGS. 3 to 9 to display a certain image. Therefore, the details described above with reference to FIGS. 2 to 9 are applied to on each pixel P and a driving method thereof.

The timing controller 200 aligns red (R), green (G), and blue (B) data RGB, which are input from an external system body (not shown) or a graphics card (not shown), so as to be matched with a pixel structure of the display panel 100, and supplies the aligned data R/G/B to the data driver 400.

Moreover, the timing controller 200 controls a driving timing of each of the scan driver 300 and data driver 400 according to a timing sync signal TSS which is input from the external system body or the graphics card. That is, the timing controller 200 generates a scan timing control signal STCS and a data timing control signal DTCS on the basis of the timing sync signal TSS including a vertical sync signal Vsync, a horizontal sync signal Hsync, a data enable signal DE, and a clock DCLK, thereby controlling the driving timing of each of the scan driver 300 and data driver 400.

The scan driver 300 generates the first to third switching control signals which are shifted in units of one horizontal period according to the scan timing signal STCS supplied from the timing controller 200, and supplies the first to third switching control signals to a plurality of pixels on each horizontal line.

The scan driver 300 may be provided in one non-display area or the other non-display area of the display panel 100 depending on a gate-in panel (GIP) type in which the scan driver 300 is provided along with a process of forming thin film transistors of the display panel 100. Alternatively, the scan driver 300 may be provided as a chip type, and mounted as a chip-on glass (COG) type in the non-display area.

The data driver 400 sequentially latches the aligned data R/G/B supplied from the timing controller 200 in response to the data timing control signal DTCS, selects gamma voltages (which respectively correspond to the latched data R/G/B) as data voltages Vdata from among a plurality of different gamma voltages, and respectively supplies the selected data voltages Vdata to the plurality of data lines DL1 to DLm during one horizontal period. Also, the data driver 400 may supply the reference voltage Vref to the plurality of pixels through the reference line RL.

To this end, the data driver 400 includes a plurality of output voltage selectors (not shown) that output a certain reference voltage Vref and data voltages Vdata during one horizontal period. The plurality of output voltage selectors 400 output the reference voltage Vref and the data voltages Vdata according to a data output selection signal included in the data timing control signal DTCS supplied from the timing controller 200.

The power supply 500 generates a driving voltage VDD necessary to drive the pixel circuit 110 by using external input power Vin, and supplies the driving voltage VDD to the switching unit 110 of each of a plurality of the pixel circuits 110.

According to the present invention, an influence of the threshold voltage of the driving transistor that controls emission of light from the light emitting element is removed, and thus, even when there is a threshold voltage difference between the plurality of driving transistors respectively formed in the plurality of pixels, the panel can output an image wholly having uniform luminance.

Moreover, according to the present invention, an influence of a voltage difference (which occurs in the light emitting element) between when the light emitting element emits light and when the light emitting element does not emit light can be removed.

Moreover, according to the present invention, an influence of the mobility of the driving transistor can be removed.

Moreover, according to the present invention, the plurality of pixels can output an image having uniform luminance, and thus, the organic light emitting display device having a large size can be manufactured.

Moreover, according to the present invention, a luminance uniformity of the organic light emitting display device can be enhanced.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A pixel circuit comprising:

a light emitting element configured to comprise an organic emission cell formed between an anode and a cathode of the light emitting element, and emit light by an electrical flow;

a driving transistor configured to control emission of light from the light emitting element according to a voltage applied between a gate and a source of the driving transistor;

a data capacitor configured to comprise a first terminal, which is connected to a first node on a reference line receiving a reference voltage, and a second terminal connected to a second node which is connected to a data line receiving a data voltage and the second terminal connected directly to the gate of the driving transistor; and a switching unit comprising an assistant capacitor having a first terminal connected to the first terminal of the data capacitor at the first node that receives the reference voltage and a second terminal directly connected to the source or a drain of the driving transistor, the switching unit configured to initialize a voltage of the data capacitor during an initialization period, store a threshold voltage of the driving transistor across the assistant capacitor during a threshold voltage storage period, store the data voltage in the data capacitor during a data voltage storage period, and emit light from the light emitting element by using the data voltage stored in the data capacitor during an emission period.

2. The pixel circuit of claim 1, wherein the switching unit comprises:

a first switching transistor configured to turn on according to a first switching control signal, and supply the reference voltage to the first terminal of the data capacitor;

a second switching transistor connected to both a gate of the driving transistor and connected to the second terminal of the data capacitor, and configured to turn on according to the first switching control signal, and supply the data voltage to the second terminal of the data capacitor;

a third switching transistor configured to turn on according to a second switching control signal, and supply a driving voltage to the source of the driving transistor; and a fourth switching transistor configured to turn on according to a third switching control signal, and supply a current, which is output from the driving transistor, to the light emitting element, wherein the assistant capacitor is connected between the first node and a third node which is connected to the source of the driving transistor.

3. The pixel circuit of claim 1, wherein, during the initialization period, the switching unit supplies the reference voltage to the first and second terminals to initialize the data capacitor, supplies the driving voltage to the driving transistor, and disconnects the light emitting element from the driving transistor, during the threshold voltage storage period, the switching unit disconnects the driving voltage, and connects the light emitting element and the driving transistor to store the threshold voltage, during the data voltage storage period, the switching unit disconnects the driving voltage, and disconnects the light emitting element from the driving transistor to store the data voltage in the data capacitor, and during the emission period, the switching unit supplies the driving voltage to the driving transistor, connects the light emitting element and the driving transistor to emit light from the light emitting element, and disconnects the reference voltage and the data voltage.

4. The pixel circuit of claim 1, wherein, during the initialization period, the switching unit supplies the reference voltage to the first and second terminals to initialize the data capacitor, supplies the driving voltage to the driving transistor, and disconnects the light emitting element from the driving transistor, during the threshold voltage storage period, the switching unit disconnects the driving voltage, connects the light emitting element and the driving transistor, and maintains the threshold voltage storage period until before a mobility voltage determined according to a mobility of the driving transistor is dropped to the threshold voltage of the driving transistor, during the data voltage storage period, the switching unit disconnects the driving voltage, and disconnects the light emitting element from the driving transistor to store the data voltage in the data capacitor, and during the emission period, the switching unit supplies the driving voltage to the driving transistor, connects the light emitting element and the driving transistor to emit light from the light emitting element, and disconnects the reference voltage and the data voltage.

5. An organic light emitting display device comprising:

a display panel configured to comprise a plurality of pixels which each comprise the pixel circuit of one of claims 1 to 4;

a data driver configured to supply the reference voltage and the data voltage to the switching unit of the pixel circuit; and a scan driver configured to drive the switching unit of the pixel circuit.

6. A method of driving a pixel circuit, which includes a light emitting element, a driving transistor that controls emission of light from the light emitting element, a data capacitor connected directly to a gate of the driving transistor, and a switching unit that drives the driving transistor with a data voltage stored in the data capacitor to emit emission of light from the light emitting element, the switching unit comprising an assistant capacitor having a first terminal connected to the first terminal of the data capacitor at the first node that receives the reference voltage and a second terminal directly connected to the source or a drain of the driving transistor, the method comprising:

during an initialization period, supplying a reference voltage to the switching unit to initialize the data capacitor;

during a threshold voltage storage period, supplying the reference voltage to the switching unit to maintain the initialization state of the data capacitor and store a threshold voltage of the driving transistor across the assistant capacitor in the switching unit;

during a data voltage storage period, supplying the reference voltage and a data voltage to the switching unit to store the data voltage in the data capacitor and store the threshold voltage across the assistant capacitor in the switching unit; and during an emission period, supplying the threshold voltage to a source of the driving transistor, and supplying the data voltage to the gate of the driving transistor to turn on the driving transistor to emit light from the light emitting element.

7. The method of claim 6, further comprising:

during the initialization period, supplying the driving voltage to the driving transistor, and disconnecting the light emitting element from the driving transistor;

during the threshold voltage storage period, disconnecting the driving voltage, and connecting the light emitting element and the driving transistor;

during the data voltage storage period, disconnecting the driving voltage, and disconnecting the light emitting element from the driving transistor; and during the emission period, supplying the driving voltage to the driving transistor, connecting the light emitting element and the driving transistor, and disconnecting the reference voltage and the data voltage.

8. The method of claim 6, further comprising:

during the initialization period, supplying the driving voltage to the driving transistor, and connecting the light emitting element and the driving transistor;

during the threshold voltage storage period, disconnecting the driving voltage, and connecting the light emitting element and the driving transistor;

during the data voltage storage period, disconnecting the driving voltage, and disconnecting the light emitting element from the driving transistor; and during the emission period, supplying the driving voltage to the driving transistor, connecting the light emitting element and the driving transistor, and disconnecting the reference voltage and the data voltage.

9. A method of driving a pixel circuit, which includes a light emitting element, a driving transistor that controls emission of light from the light emitting element, a data capacitor directly connected to a gate of the driving transistor, and a switching unit that drives the driving transistor with a data voltage stored in the data capacitor to emit emission of light from the light emitting element, the switching unit comprising an assistant capacitor having a first terminal connected to the first terminal of the data capacitor at the first node that receives the reference voltage and a second terminal directly connected to the source or a drain of the driving transistor, the method comprising:

during an initialization period, supplying a reference voltage to the switching unit to initialize the data capacitor;

during a threshold voltage storage period, supplying the reference voltage to the switching unit to maintain the initialization state of the data capacitor and store a mobility voltage that is associated with a mobility of the driving transistor across the assistant capacitor, in the switching unit;

during a data voltage storage period, supplying the reference voltage and a data voltage to the switching unit to store the data voltage in the data capacitor and store the mobility voltage across the assistant capacitor in the switching unit; and during an emission period, supplying the mobility voltage and the reference voltage to a source of the driving transistor, and supplying the data voltage to the gate of the driving transistor to turn on the driving transistor to emit light from the light emitting element.

10. The method of claim 9, further comprising:

during the initialization period, supplying the driving voltage to the driving transistor, and disconnecting the light emitting element from the driving transistor;

during the threshold voltage storage period, disconnecting the driving voltage, connecting the light emitting element and the driving transistor, and maintaining the threshold voltage storage period until before the mobility voltage is dropped to the threshold voltage of the driving transistor;

during the data voltage storage period, disconnecting the driving voltage, and disconnecting the light emitting element from the driving transistor; and during the emission period, supplying the driving voltage to the driving transistor, connecting the light emitting element and the driving transistor, and disconnecting the reference voltage and the data voltage.

* * * * *